US010020620B2

(12) United States Patent
Yuba et al.

(10) Patent No.: US 10,020,620 B2
(45) Date of Patent: Jul. 10, 2018

(54) CONNECTOR

(71) Applicant: FUJITSU COMPONENT LIMITED, Tokyo (JP)

(72) Inventors: Takashi Yuba, Tokyo (JP); Koichi Kiryu, Nagano (JP); Akio Nakamura, Tokyo (JP); Hideo Miyazawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/678,347

(22) Filed: Aug. 16, 2017

(65) Prior Publication Data

US 2017/0365958 A1 Dec. 21, 2017

Related U.S. Application Data

(60) Division of application No. 15/017,725, filed on Feb. 8, 2016, now Pat. No. 9,774,145, which is a continuation of application No. PCT/JP2013/072531, filed on Aug. 23, 2013.

(51) Int. Cl.

| | |
|---|---|
| ***H01R 13/66*** | (2006.01) |
| ***H01R 24/76*** | (2011.01) |
| ***H01R 13/53*** | (2006.01) |
| *H01R 103/00* | (2006.01) |

(52) U.S. Cl.

CPC ..... *H01R 13/6625* (2013.01); *H01R 13/53* (2013.01); *H01R 13/6616* (2013.01); *H01R 24/76* (2013.01); *H01R 2103/00* (2013.01)

(58) Field of Classification Search

CPC .. H01R 13/70; H01R 13/703; H01R 13/7036; H01R 13/6616; H01R 13/6658; H01R 13/6625; H01R 2103/00

USPC ..... 439/181, 620.21; 200/51 R, 51.09, 51.11

See application file for complete search history.

(56) References Cited

U.S. PATENT DOCUMENTS

| | | | | |
|---|---|---|---|---|
| 3,813,579 A | | 5/1974 | Doyle et al. | |
| 5,384,492 A | | 1/1995 | Carlson et al. | |
| 5,726,506 A | * | 3/1998 | Wood | H02B 1/24 307/147 |

(Continued)

FOREIGN PATENT DOCUMENTS

| | | |
|---|---|---|
| CA | 2844268 | 2/2013 |
| CN | 201805036 U | 4/2011 |

(Continued)

*Primary Examiner* — Hien Vu

(74) *Attorney, Agent, or Firm* — IPUSA, PLLC

(57) ABSTRACT

There is provided a connector connectable to a mating connector that includes a first jack terminal configured to be coupled to a first plug terminal of the mating connector; a second jack terminal configured to be coupled to a second plug terminal of the mating connector; and a third jack terminal configured to be coupled to the second plug terminal of the mating connector, and having a resistor and a capacitor connected in series thereto. Upon the connector being separated from the mating connector, the second jack terminal is separated from the second plug terminal after the third jack terminal is separated from the second plug terminal, and the first jack terminal is separated from the first plug terminal after the second jack terminal is separated from the second plug terminal.

3 Claims, 12 Drawing Sheets

(56) References Cited

U.S. PATENT DOCUMENTS

| | | | | |
|---|---|---|---|---|
| 5,909,065 | A * | 6/1999 | Jones | H02H 9/004 307/147 |
| 6,006,298 | A * | 12/1999 | Satoh | G06F 13/4072 307/147 |
| 6,524,117 | B1 * | 2/2003 | Murakami | H01R 13/193 439/74 |
| 6,954,536 | B2 * | 10/2005 | Tanaka | H04B 1/034 381/122 |
| 7,982,145 | B2 | 7/2011 | Yuba et al. | |
| 2001/0046130 | A1 | 11/2001 | Cunningham et al. | |

FOREIGN PATENT DOCUMENTS

| | | |
|---|---|---|
| JP | H05-075282 | 3/1993 |
| JP | H05-082208 | 4/1993 |
| JP | 2003-031301 | 1/2003 |
| JP | 2003-203721 | 7/2003 |
| JP | 2004-158331 | 6/2004 |
| JP | 2009-146777 | 7/2009 |
| JP | 2010-056056 | 3/2010 |
| JP | 2010-118173 | 5/2010 |
| JP | 2013-168347 | 8/2013 |

* cited by examiner

200

CONNECTOR

CROSS-REFERENCE TO RELATED APPLICATIONS

The present application is a divisional application and claims priority under 35 U.S.C. 120 to U.S. patent application Ser. No. 15/017,725 filed on Feb. 8, 2016, which claims benefit under 35 U.S.C. 120 and 365(c) of PCT International Application No. PCT/JP2013/072531, filed on Aug. 23, 2013 and designating the U.S. The entire contents of the foregoing application are incorporated herein by reference.

BACKGROUND OF THE INVENTION

1. Field of the Invention

The present invention relates to connectors.

2. Description of the Related Art

Generally, an electronic apparatus operates being powered from a power supply. When receiving a supply of electric power from a power source, the electric power is supplied to the electronic apparatus through a common connector. As disclosed in Patent Document 1 and 2, as for the connector, a convex male-type plug connector and a concave female-type jack connector are coupled to each other so as to be electrically connected. Commonly, a plug connector is provided in the electronic apparatus and a device having one or more jack connectors is referred to as an outlet.

Also, recently, even for a local area power transmission, a DC high voltage power supply method, which does not require a thick cable, with low power loss in voltage conversion, in power transmission, etc., is planned to be adopted as a global warming countermeasure, and the like. In particular, such a power supply method is preferable for information processing apparatuses that consume a large amount of electric power, such as servers.

However, arc discharge may occur when cutting off the DC high voltage power supply. Heat caused by the arc discharge may harm the connector and electronic components.

Therefore, in Patent Documents 3 and 4, a method is disclosed, which extinguishes the arc discharge by a mechanical switch disposed in the connector so as to prevent adverse effects on the connector and the electronic components.

However, in a case where the mechanical switch is disposed in the connector, a size of the connector increases and a cost of the connector increases since assemblies for forming the mechanical switch are required. Also, a product life of the mechanical switch is short since the mechanical switch operates and is consumed. Hence the product life of the connector including the mechanical switch is short.

CITATION LIST

Patent Document

[Patent Document 1]: Japanese Laid-open Patent Publication No. H5-82208

[Patent Document 2]: Japanese Laid-open Patent Publication No. 2003-31301

[Patent Document 3]: Japanese Laid-open Patent Publication No. 2010-56056

[Patent Document 4]: Japanese Laid-open Patent Publication No. 2010-118173

SUMMARY OF THE INVENTION

An object of disclosure of the present technology is to provide a connector capable of suppressing occurrence of the arc discharge, where the size and cost of the connector can be reduced.

According to an embodiment of the present invention, there is provided a connector connectable to a mating connector that includes a first jack terminal configured to be coupled to a first plug terminal of the mating connector; a second jack terminal configured to be coupled to a second plug terminal of the mating connector; and a third jack terminal configured to be coupled to the second plug terminal of the mating connector, and having a resistor and a capacitor connected in series thereto. Upon the connector being separated from the mating connector, the second jack terminal is separated from the second plug terminal after the third jack terminal is separated from the second plug terminal, and the first jack terminal is separated from the first plug terminal after the second jack terminal is separated from the second plug terminal.

DESCRIPTION OF THE EMBODIMENTS

<First Embodiment>

(Connector)

Figure 1:
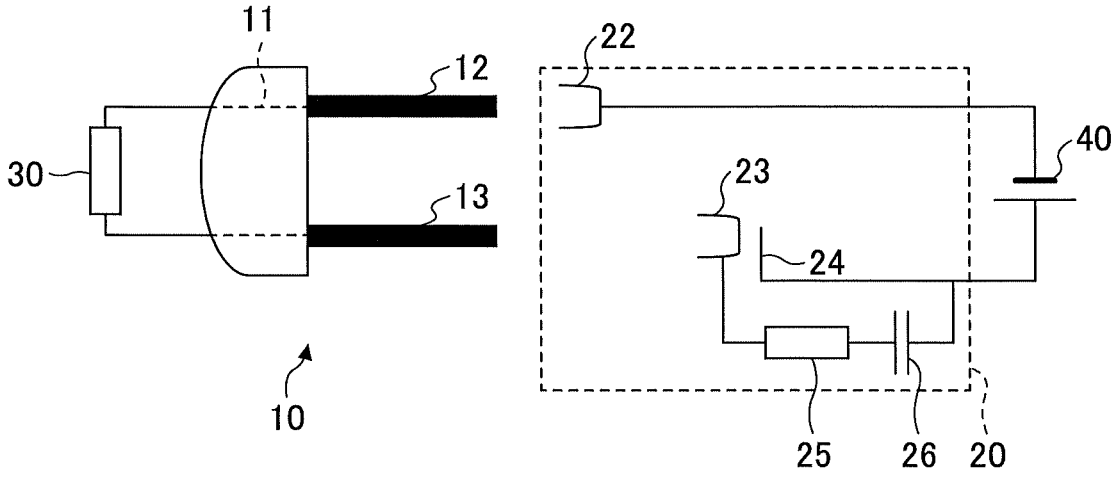
FIG. 1 is a diagram for illustrating a structure of a connector of a first embodiment.

In the following, a connector of a first embodiment will be described. As shown in FIG. 1, in the present embodiment, a male connector 10 and a female connector 20 are engaged with each other so as to be mutually connected. Additionally, in the present embodiment, the connector may mean a pair of the male connector 10 and the female connector 20, and may mean the female connector 20, or the like.

The male connector 10 includes a male connector main part 11, a negative plug terminal 12 and a positive plug terminal 13. The negative plug terminal 12 and the positive plug terminal 13 are coupled to an electronic apparatus 30, etc., which operates when DC power is supplied. Additionally, in the male connector 10, a length of the negative plug terminal 12 is approximately same as the length of the positive plug terminal 13. Also, in the present embodiment, a negative plug terminal and a negative jack terminal respectively mean a plug terminal and jack terminal of a negative electrode, while a positive plug terminal and a positive jack terminal respectively mean a plug terminal and jack terminal of a positive electrode. Also, the negative electrode may be referred to one electrode, while the positive electrode may be referred to the other electrode.

The female connector 20 includes a negative jack terminal 22, a first positive jack terminal 23, a second positive jack terminal 24, a resistor 25 and a capacitor 26. The female connector 20 is coupled to a power supply 40 capable of supplying DC power whose voltage is approximate 30V. Additionally, a rated voltage of the power supply 40 may exceed 30 VDC and may be approximate 400 VDC. Specifically, a negative jack terminal 22 is coupled to a negative electrode of the power supply 40, while the second positive jack terminal 24 and the first positive jack terminal 23 via the resistor 25 and the capacitor 26 are coupled to a positive electrode of the power supply 40.

Also, the negative jack terminal 22 is positioned closer to the male terminal 10 in comparison to the first positive jack terminal 23 in a state where the female connector 20 is ready to be engaged with the male connector 10. Also, the first positive jack terminal 23 is positioned closer to the male connector 10 in comparison to the second positive jack terminal 24. That is, the first positive jack terminal 23 and the second positive jack terminal 24 are disposed on a line extended in a length direction of the positive plug terminal 13. The first positive jack terminal 23 and the second positive jack terminal 24 are in contact with the positive plug terminal 13, where the second positive jack terminal 24 is disposed at back side of the first positive jack terminal 23.

As described above, the resistor 25 and the capacitor 26 are disposed between the positive electrode of the power supply 40 and the second positive jack terminal 24. Specifically, the positive electrode of the power supply 40 is coupled to one terminal of the capacitor 26, and the other terminal of the capacitor 26 is coupled to one terminal of the resistor 25, where the other terminal of the resistor 25 is coupled to the first positive jack terminal 23. Additionally, in the present embodiment, the negative (or minus) electrode may be referred to as one electrode, while the positive (or plus) electrode may be referred to as the other electrode.

(Method for Connecting Connectors and for Releasing Connection of Connectors)

In the following, a method for connecting the connectors and for releasing the connection thereof of the present embodiment will be described. The method for connecting the connectors of the present embodiment will be described with reference to FIG. 2 and FIG. 3, and the method for releasing the connection thereof of the present embodiment will be described with reference to FIG. 4 and FIG. 5.

In a case where the connectors of the present embodiment are connected, the male connector 10 and the female connector 20 are made to be closer to each other so as to contact with each other and engage the male connector 10 with the female connector 20.

Figure 2A:
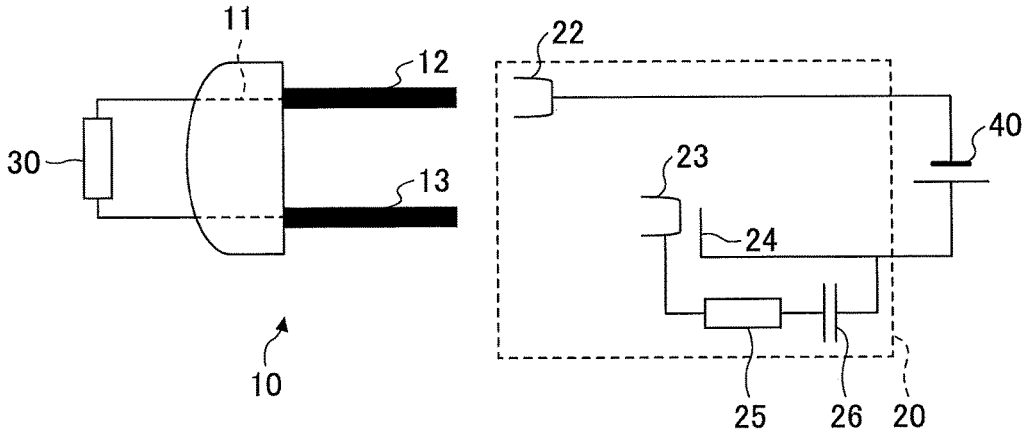
FIG. 2A is a diagram for illustrating a method for connecting the connectors of the first embodiment.
Figure 2B:
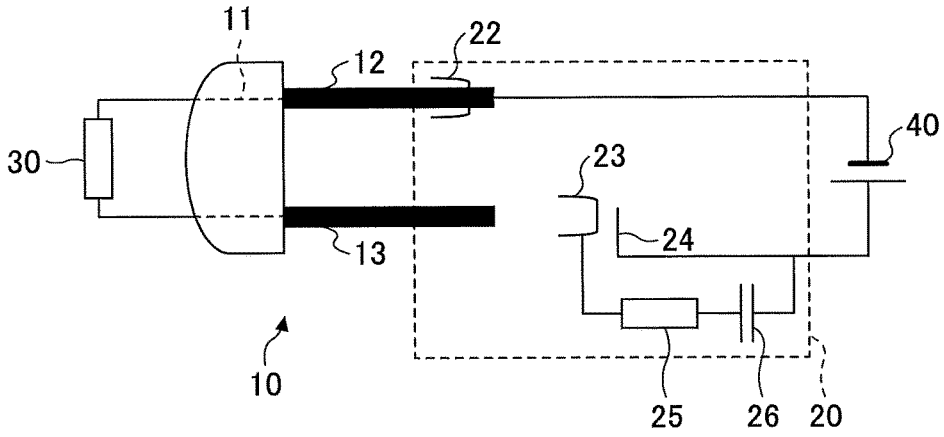
FIG. 2B is another diagram for illustrating the method for connecting the connectors of the first embodiment.

Specifically, a male connector 10 separated from the female connector 20, as shown in FIG. 2A, is made to be closer to the female connector 20. Then, the male connector 10 and the female connector 20 are in a state shown in FIG. 2B. Thus, the negative plug terminal 12 of the male connector 10 is in contact with the negative jack terminal 22 of the female connector 20. However, in a state shown in FIG. 2B, the electronic apparatus 30 is not powered from the power supply 40 through the male connector 10 and the female connector 20 since the positive plug terminal 13 does not contact with the second positive jack terminal 24.

Figure 3A:
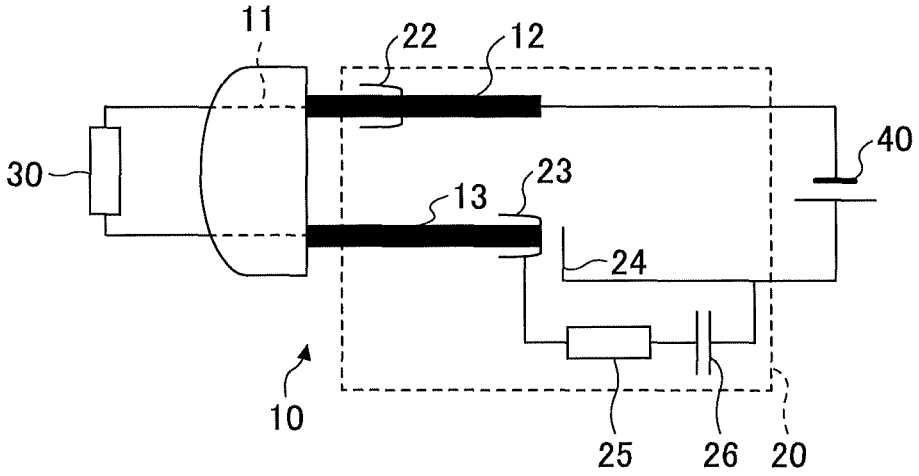
FIG. 3A is another diagram for illustrating the method for connecting the connectors of the first embodiment.

Then, the male connector 10 is made further closer to the female connector 20. The positive plug terminal 13 of the male connector 10 becomes in contact with the first positive jack terminal 23 of the female connector 20, as shown in FIG. 3A. However, in a state shown in FIG. 3A, the electronic apparatus 30 is not powered from the power supply 40 through the male connector 10 and the female connector 20 since the first positive jack terminal 23 is insulated from the positive electrode of the power supply 40 by means of the capacitor 26 disposed between the first positive jack terminal 23 and the positive electrode of the power supply 40.

Figure 3B:
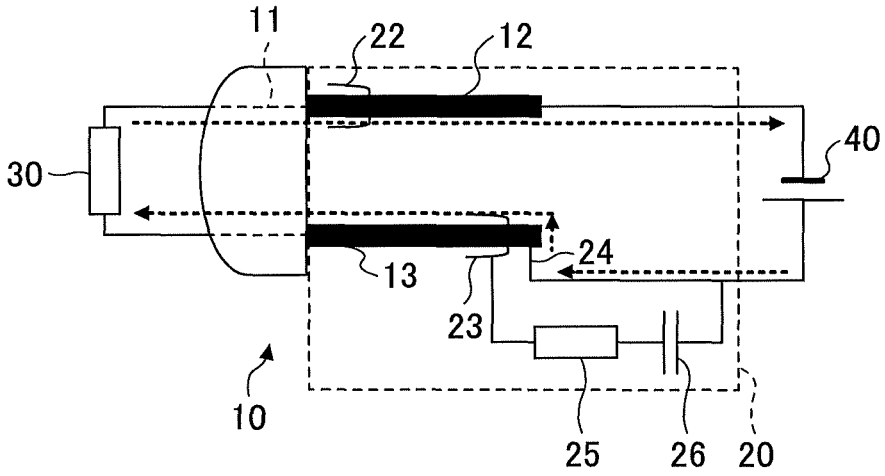
FIG. 3B is another diagram for illustrating the method for connecting the connectors of the first embodiment.

Then, the male connector 10 is made further closer to the female connector 20. The positive plug terminal 13 of the male connector 10 becomes in contact with the second positive jack terminal 24 of the female connector 20 as shown in FIG. 3B. In a state shown in FIG. 3B, the negative plug terminal 12 of the male connector 10 is in contact with the negative jack terminal 22 of the female connector 20 while the second positive jack terminal 24 is in contact with the positive electrode of the power supply 40. Hence, the electronic apparatus 30 is powered from the power supply 40 through the male connector 10 and the female connector 20 when the positive plug terminal 13 of the male connector 10 and the second positive jack terminal 24 of the female connector 20 are in contact with each other.

In the following, the method for releasing the connection of the connectors of the present embodiment will be described.

When the connection of the connectors of the present embodiment is released, the male connector 10 is separated from the female connector 20, that is, the male connector 10 is pulled off from the female connector 20.

Figure 4A:
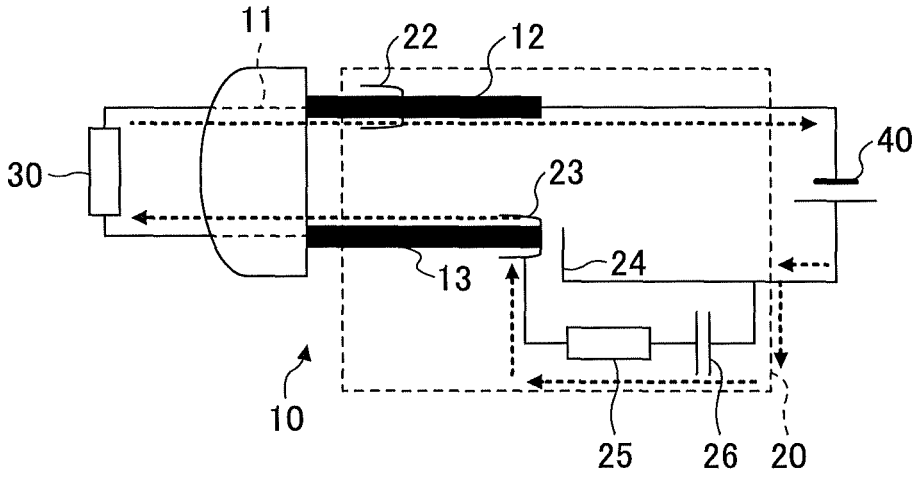
FIG. 4A is a diagram for illustrating a method for releasing the connection of the connectors of the first embodiment.

Specifically, the male connecter 10 in the state shown in FIG. 3B, where the electronic apparatus 30 is powered from the power supply 40 through the male connector 10 and the female connector 20, is started to be separated from the female connector 20 as shown in FIG. 4A. Then, the positive plug terminal 13 of the male connector 10 is separated from the second positive jack terminal 24 of the female connector 20. Hence the power of the power supply 40 cannot be provided through the second positive jack terminal 24.

However, in a state shown in FIG. 4A, the positive plug terminal 13 of the male connector 10 is in contact with the first positive jack terminal 23 of the female connector 20. Therefore, charge accumulated in the capacitor 26 is discharged to the positive plug terminal 13 of the male connector 10 through the resistor 25. In this case, the current flows by discharging the charge accumulated in the capacitor 26 being limited by the resistor 25, hence the current is limited. Also, a potential at the positive plug terminal 13 gradually decreases. Therefore, arc discharge does not occur between the positive plug terminal 13 of the male terminal 10 and the second positive jack terminal 24 of the female connector 20.

Upon all the charge accumulated in the capacitor 26 being discharged, the power of the power supply 40 is not provided to the electronic apparatus 30 because the first positive jack terminal 23 is insulated from the positive electrode of the power supply 40 by the capacitor 26 disposed between the positive electrode of the power supply 40 and the first positive jack terminal 23.

Figure 4B:
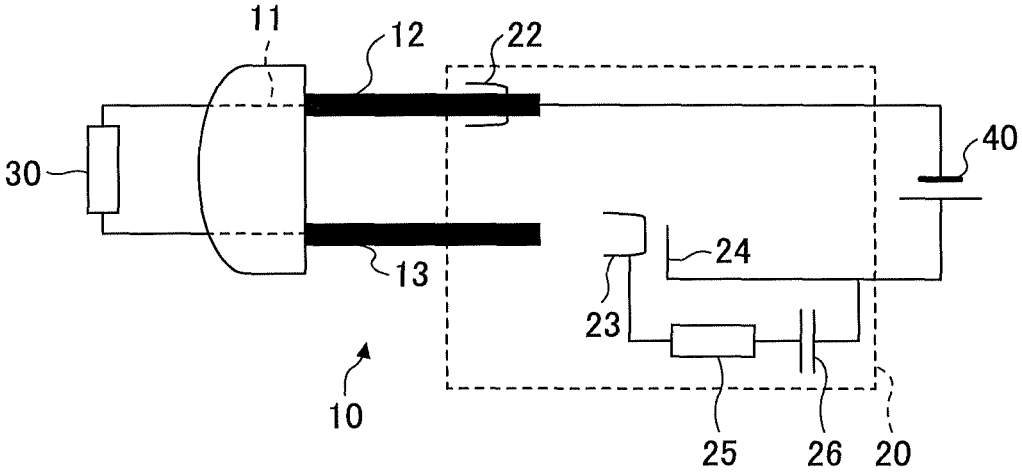
FIG. 4B is another diagram for illustrating the method for releasing the connection of the connectors of the first embodiment.

Then, the male connector 10 is further separated from the female connector 20. The positive plug terminal 13 of the male connector 10 is separated from the first positive jack terminal 23 of the female connector 20 as shown in FIG. 4B. In a state shown in FIG. 4B, the negative plug terminal 12 of the male connector 10 is in contact with the negative jack terminal 22 of the female connector 20, whereas the positive plug terminal 13 is not in contact with the second positive jack terminal 24. Therefore, the power of the power supply 40 is not provided to the electronic apparatus 30 through the male connector 10 and the female connector 20.

Figure 5:
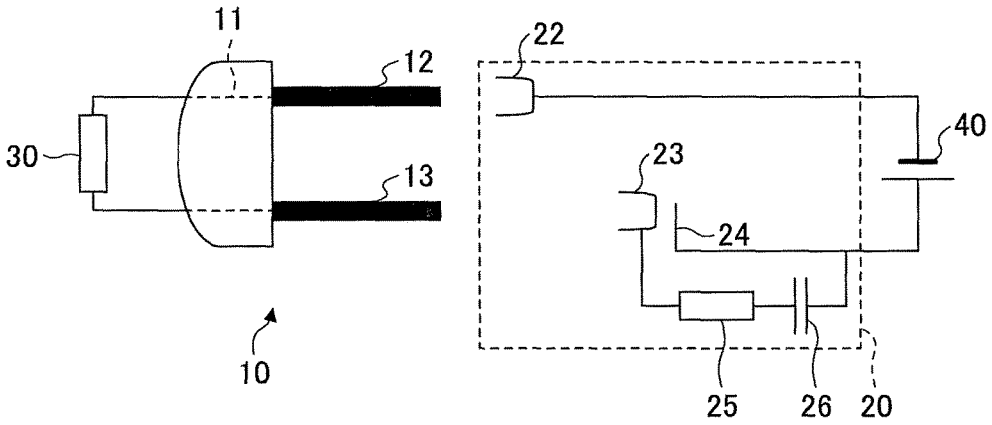
FIG. 5 is another diagram for illustrating the method for releasing the connection of the connectors of the first embodiment.

Then, the male connector 10 is further separated from the female connector 20. The negative plug terminal 12 of the male connector 10 is separated from the negative jack terminal 22 of the female connector 20, thereby pulling off the male connector 10 from the female connector 20 as shown in FIG. 5. Thus, the connection of the connectors of the present embodiment is released.

<Second Embodiment>

(Connector)

Figure 6:
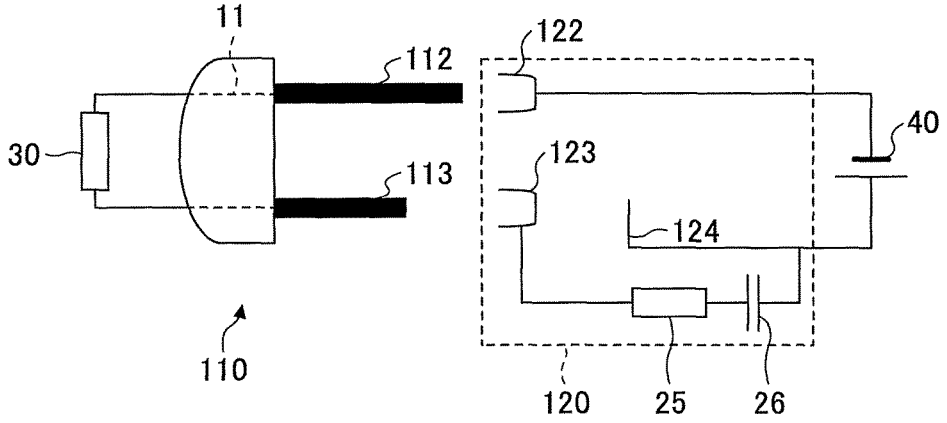
FIG. 6 is a diagram for illustrating a structure of the connector of a second embodiment.

In the following, a connector of the second embodiment will be described. As shown in FIG. 6, in the present embodiment, a male connector 110 and a female connector 120 are engaged with each other so as to be mutually connected. Additionally, in the present embodiment, the connector may mean a pair of the male connector 110 and the female connector 120, and may mean the female connector 120.

The male connector 110 includes a male connector main part 11, a negative plug terminal 112 and a positive plug terminal 113. The negative plug terminal 112 and the positive plug terminal 113 are coupled to an electronic apparatus 30, etc., which operates when DC power is supplied. In the male connector 110, the negative plug terminal 112 is longer than the positive plug terminal 113.

The female connector 120 includes a negative jack terminal 122, a first positive jack terminal 123, a second positive jack terminal 124, a resistor 25 and a capacitor 26. The female connector 120 is coupled to a power supply 40 capable of supplying DC power whose voltage is approximate 30V. Additionally, a rated voltage of the power supply 40 may exceed 30 VDC and may be approximate 400 VDC. Specifically, a negative jack terminal 122 is coupled to a negative electrode of the power supply 40, while the second positive jack terminal 124 and the first positive jack terminal 123 via the resistor 25 and a capacitor 26 are coupled to a positive electrode of the power supply 40.

Also, the first positive jack terminal 123 is positioned closer to male connecter 110 in comparison to the second positive jack terminal 124 in a state where the female connector 120 is ready to be engaged with the male connector 110. That is, the first positive jack terminal 123 and the second positive jack terminal 124 are disposed on a line extended in a length direction of the positive plug terminal 113. The first positive jack terminal 123 and the second positive jack terminal 124 are in contact with the positive plug terminal 113, where the second positive jack terminal 124 is disposed at back side of the first positive jack terminal 123.

As described above, the resistor 25 and the capacitor 26 are disposed between the positive electrode of the power supply 40 and the second positive jack terminal 124. Specifically, the positive electrode of the power supply 40 is coupled to one terminal of the capacitor 26, and the other terminal of the capacitor 26 is coupled to one terminal of the resistor 25, where the other terminal of the resistor 25 is coupled to the first positive jack terminal 123.

(Method for Connecting Connectors and for Releasing Connection of Connectors)

In the following, a method for connecting the connectors and for releasing the connection thereof of the present embodiment will be described. The method for connecting the connectors of the present embodiment will be described with reference to FIG. 7 and FIG. 8, and the method for releasing the connection thereof of the present embodiment will be described with reference to FIG. 9 and FIG. 10.

In a case where the connectors of the present embodiment are connected, the male connector 110 and the female connector 120 are made to be closer to each other so as to contact with each other and engage the male connector 110 with the female connector 120.

Figure 7A:
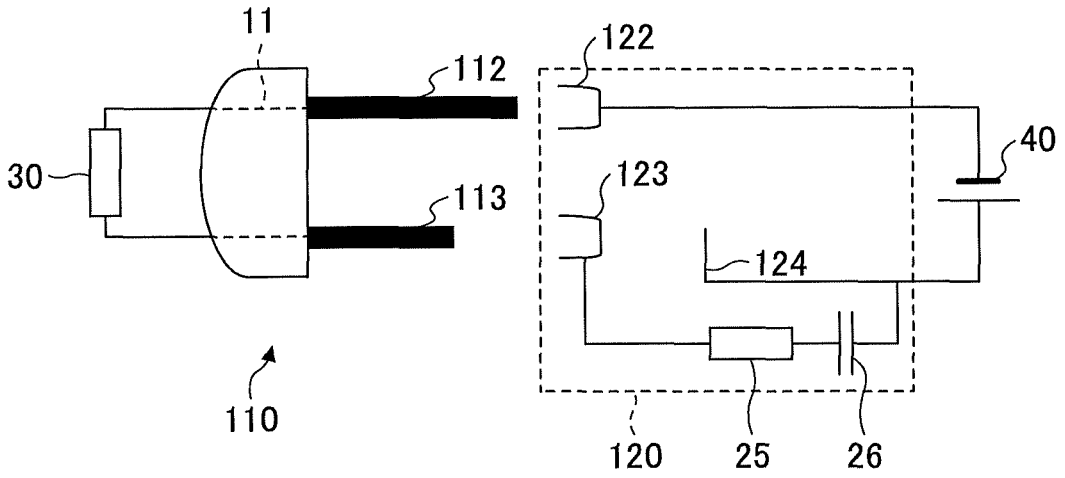
FIG. 7A is a diagram for illustrating a method for connecting the connectors of the second embodiment.
Figure 7B:
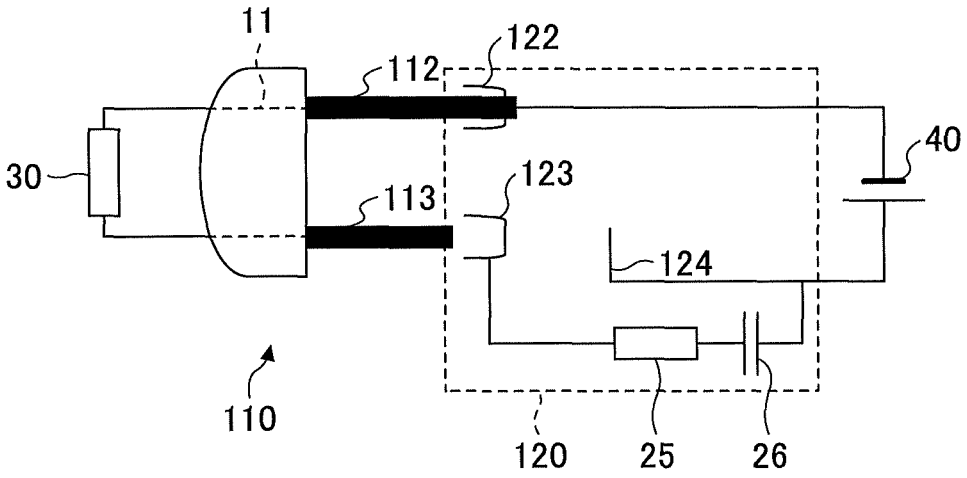
FIG. 7B is another diagram for illustrating the method for connecting the connectors of the second embodiment.

Specifically, a male connector 110 separated from the female connector 120, as shown in FIG. 7A, is made to be closer to the female connector 120. Then, the male connector 110 and the female connector 120 are in a state shown in FIG. 7B. Thus, the negative plug terminal 112 of the male connector 110 is in contact with the negative jack terminal 122 of the female connector 120. However, in a state shown in FIG. 7B, the electronic apparatus 30 is not powered from the power supply 40 through the male connector 110 and the female connector 120 since the positive plug terminal 113 does not contact with the second positive jack terminal 124.

Figure 8A:
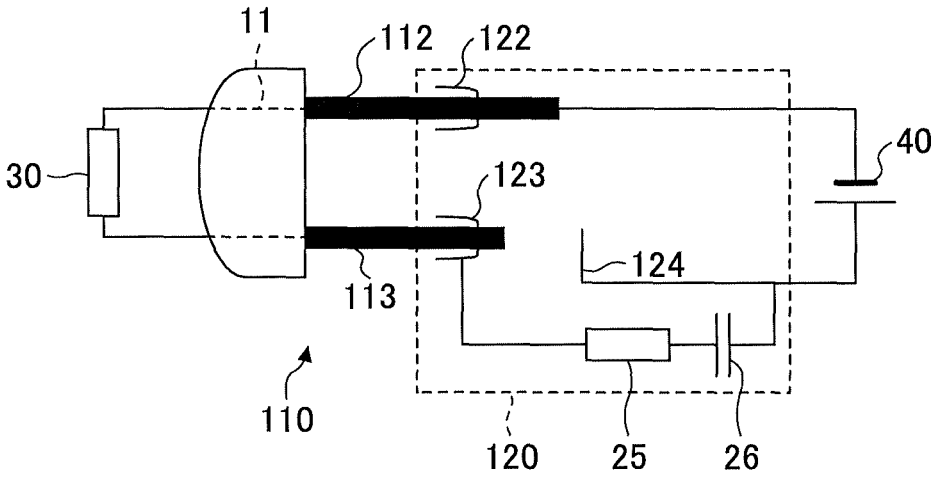
FIG. 8A is another diagram for illustrating the method for connecting the connectors of the second embodiment.

Then, the male connector 110 is made further closer to the female connector 120. The positive plug terminal 113 of the male connector 110 becomes in contact with the first positive jack terminal 123 of the female connector 120, as shown in FIG. 8A. However, in a state shown in FIG. 8A, the electronic apparatus 30 is not powered from the power supply 40 through the male connector 110 and the female connector 120 since the first positive jack terminal 123 is insulated from the positive electrode of the power supply 40 by means of the capacitor 26 disposed between the first positive jack terminal 123 and the positive electrode of the power supply 40.

Figure 8B:
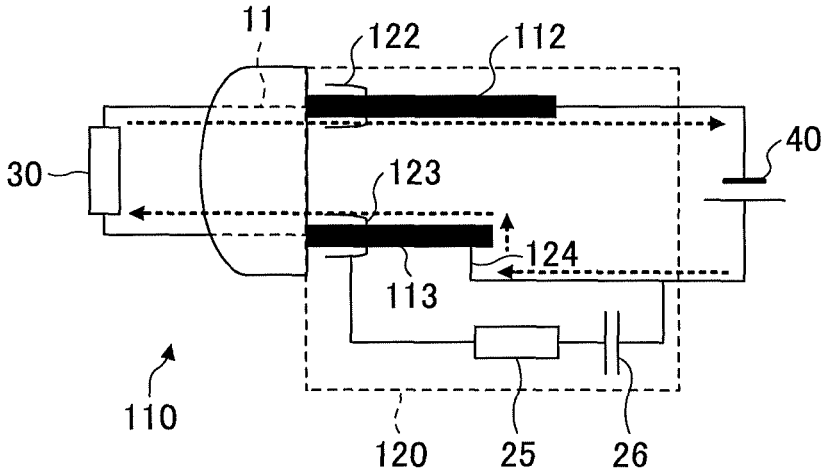
FIG. 8B is another diagram for illustrating the method for connecting the connectors of the second embodiment.

Then, the male connector 110 is made further closer to the female connector 120. The positive plug terminal 113 of the male connector 110 becomes in contact with the second positive jack terminal 124 of the female connector 120 as shown in FIG. 8B. In a state shown in FIG. 8B, the negative plug terminal 112 of the male connector 110 is in contact with the negative jack terminal 122 of the female connector 120 while the second positive jack terminal 124 is in contact with the positive electrode of the power supply 40. Hence, the electronic apparatus 30 is powered from the power supply 40 through the male connector 110 and the female connector 120 when the positive plug terminal 113 of the male connector 110 and the second positive jack terminal 124 of the female connector 120 are in contact with each other.

In the following, the method for releasing the connection of the connectors of the present embodiment will be described.

When the connection of the connectors of the present embodiment is released, the male connector 110 is separated from the female connector 120, that is, the male connector 110 is pulled off from the female connector 120.

Figure 9A:
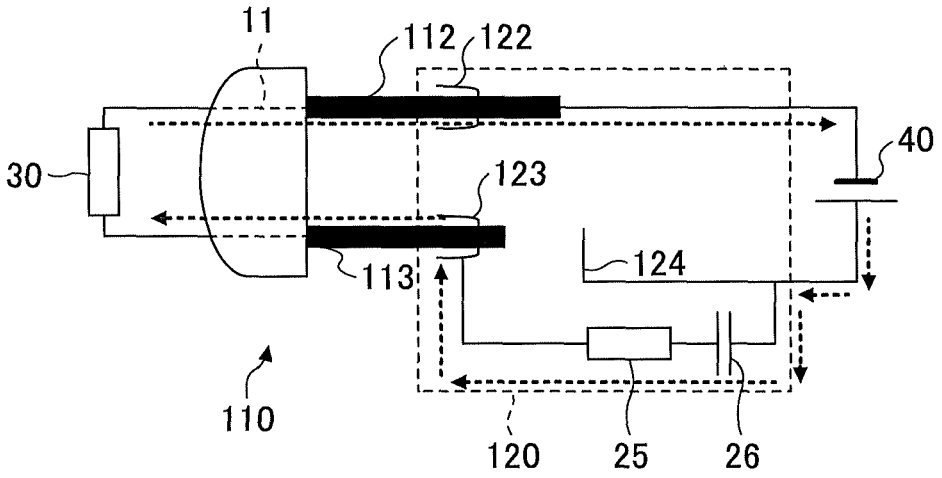
FIG. 9A is a diagram for illustrating a method for releasing the connection of the connectors of the second embodiment.

Specifically, the male connecter 110 in the state shown in FIG. 8B, where the electronic apparatus 30 is powered from the power supply 40 through the male connector 110 and the female connector 120, is started to be separated from the female connector 120 as shown in FIG. 9A. Then, the positive plug terminal 113 of the male connector 110 is separated from the second positive jack terminal 124 of the female connector 120. Hence the power of the power supply 40 cannot be provided through the second positive jack terminal 124.

However, in a state shown in FIG. 9A, the positive plug terminal 113 of the male connector 110 is in contact with the first positive jack terminal 123 of the female connector 120. Therefore, charge accumulated in the capacitor 26 is discharged to the positive plug terminal 113 of the male connector 110 through the resistor 25. In this case, the current flows by discharging the charge accumulated in the capacitor 26 being limited by the resistor 25, hence the current is limited. Also, a potential at the positive plug terminal 113 gradually decreases. Therefore, arc discharge does not occur between the positive plug terminal 113 of the male terminal 110 and the second positive jack terminal 124 of the female connector 120.

Upon all the charge accumulated in the capacitor 26 being discharged, the power of the power supply 40 is not provided to the electronic apparatus 30 because the first positive jack terminal 123 is insulated from the positive electrode of the power supply 40 by the capacitor 26 disposed between the positive terminal of the power supply 40 and the first positive jack terminal 123.

Figure 9B:
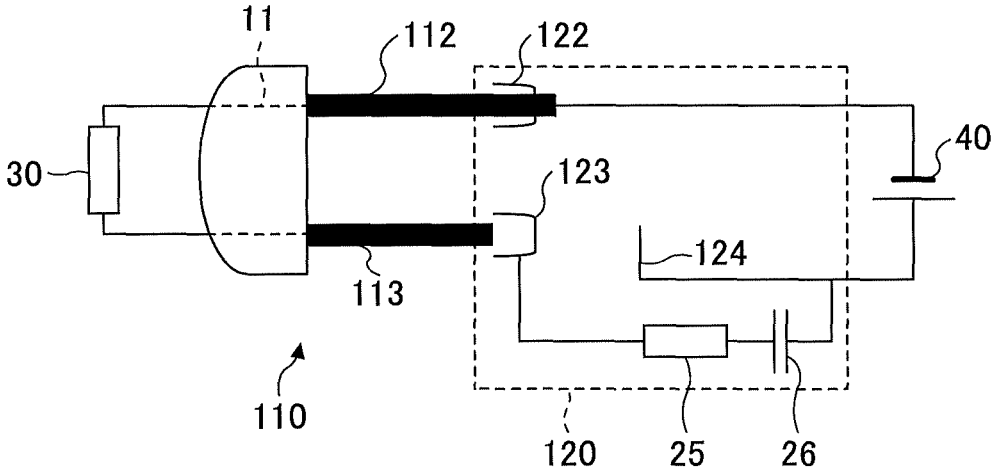
FIG. 9B is another diagram for illustrating the method for releasing the connection of the connectors of the second embodiment.

Then, the male connector 110 is further separated from the female connector 120. The positive plug terminal 113 of the male connector 110 is separated from the first positive jack terminal 123 of the female connector 120 as shown in FIG. 9B. In a state shown in FIG. 9B, the negative plug terminal 112 of the male connector 110 is in contact with the negative jack terminal 122 of the female connector 120, whereas the positive plug terminal 113 is not in contact with the second positive jack terminal 124. Therefore, the power of the power supply 40 is not provided to the electronic apparatus 30 through the male connector 110 and the female, connector 120.

Figure 10:
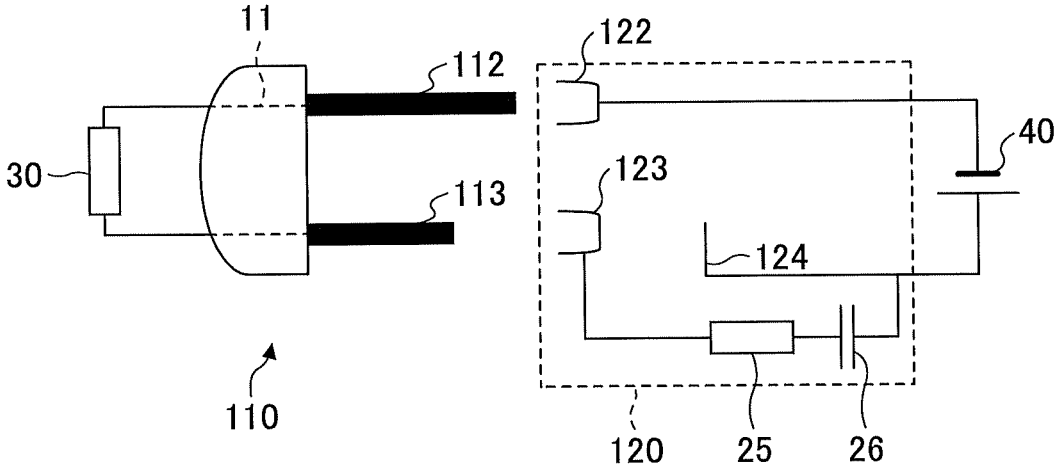
FIG. 10 is another diagram for illustrating the method for releasing the connection of the connectors of the second embodiment.

Then, the male connector 110 is further separated from the female connector 120. The negative plug terminal 112 of the male connector 110 is separated from the negative jack terminal 122 of the female connector 120, and the male connector 110 is pulled off from the female connector 120 as shown in FIG. 10. Thus, the connection of the connectors of the present embodiment is released.

Additionally, details of the second embodiment other than aforementioned matters are similar to the case of the first embodiment.

<Structure of Connector>

In the following, a structure, an appearance, etc. of a common connector 200, which is not the connector of the present embodiment, will be described with reference to FIG. 11 to FIG. 17. The connector 200 includes a GND terminal 221, a negative jack terminal 222 and a positive jack terminal 223, where the connector 200 is disposed on a printed substrate 230. The GND terminal 221, the negative jack terminal 222 and a positive jack terminal 223 disposed on the printed substrate 230 are covered with a cover unit 210. The cover unit 210 includes an opening portion 211 corresponding to the GND terminal 221, an opening portion 212 corresponding to the negative jack terminal 222, and an opening portion 213 corresponding to the positive jack terminal 223. An internal insulation unit 231 surrounding the GND terminal 221, the negative jack terminal 222 and the positive jack terminal 223 disposed on the printed substrate 230 is included in the cover unit 210.

Figure 11:
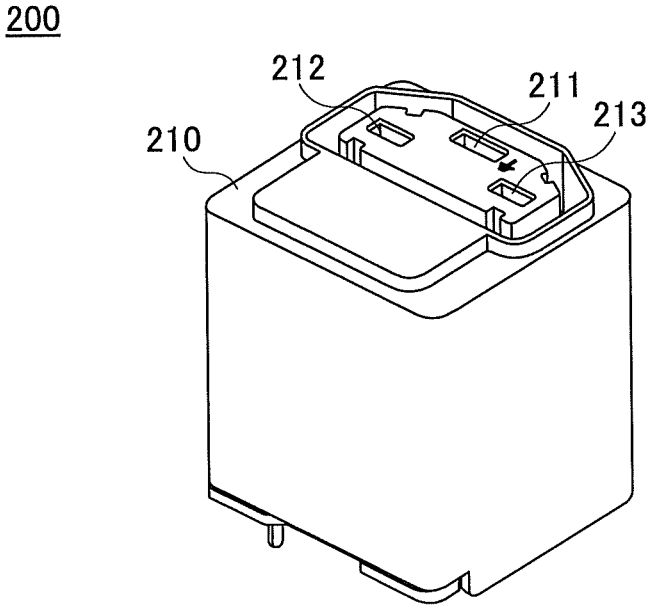
FIG. 11 is a perspective view for illustrating an appearance of the connector 200.
Figure 12:
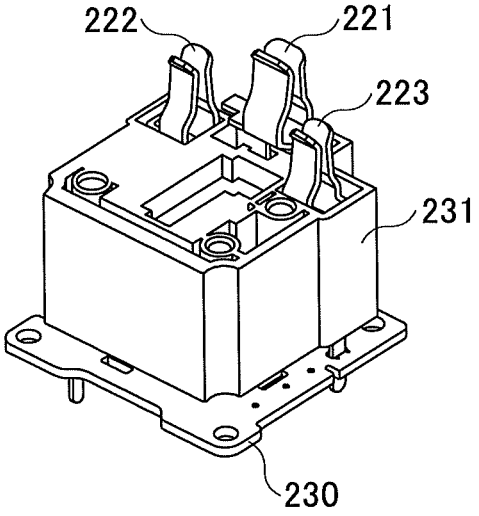
FIG. 12 is a perspective view of the connector 200 from which a cover unit 210 is removed.
Figure 13:
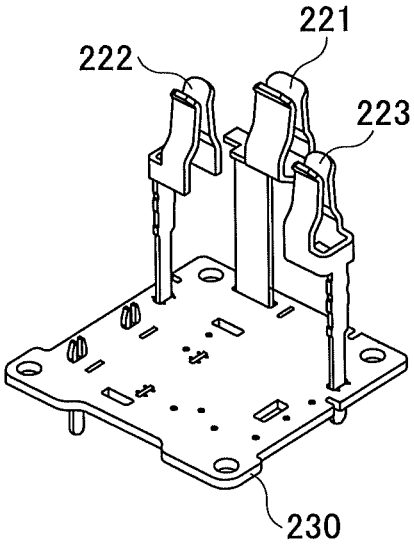
FIG. 13 is a perspective view of the connector 200 from which an internal insulation unit 231 is further removed.
Figure 14:
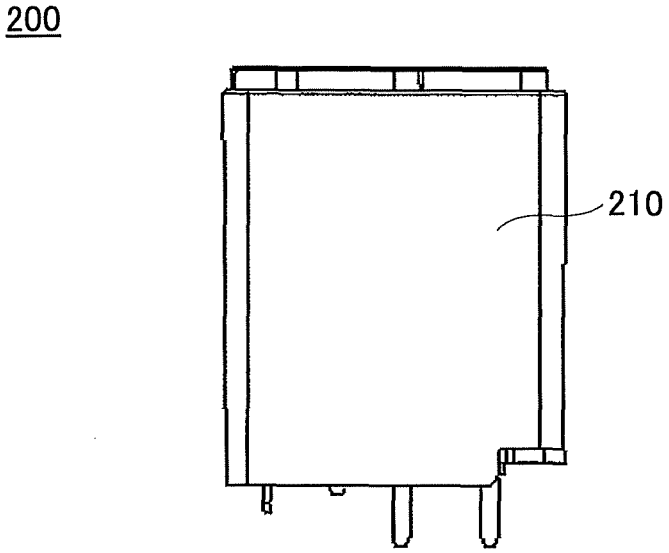
FIG. 14 is a side view of the connector 200.
Figure 15:
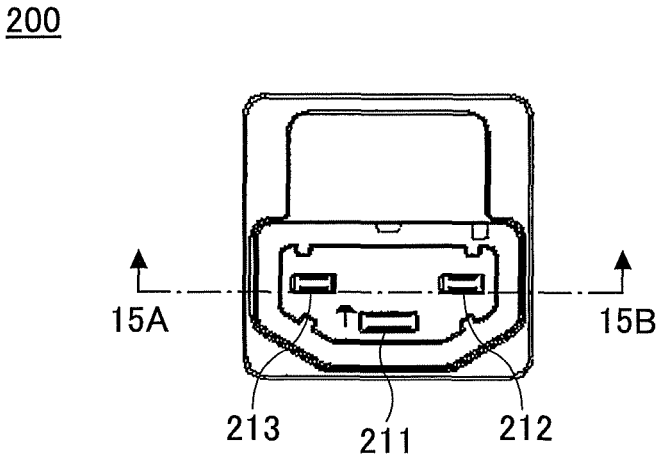
FIG. 15 is a top view of the connector 200.
Figure 16:
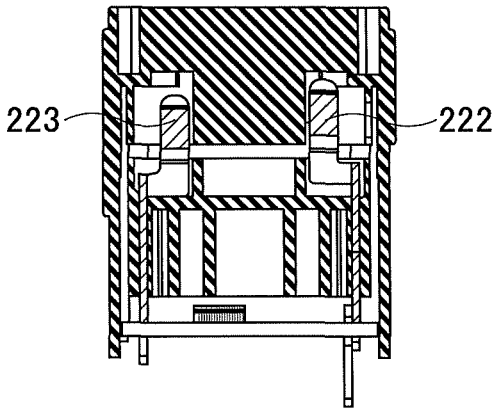
FIG. 16 is a cross-sectional view of the connector 200.
Figure 17:
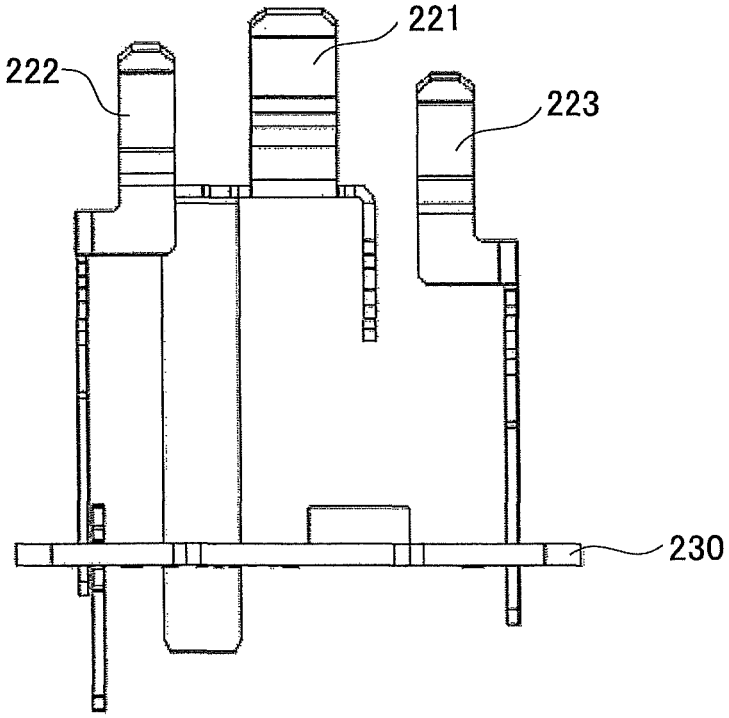
FIG. 17 is a side view for illustrating the connector 200 from which the internal insulation unit 231 is removed.

Additionally, FIG. 11 is a perspective view for illustrating an appearance of the connector 200. FIG. 12 is a perspective view of the connector 200 from which the cover unit 210 is removed. FIG. 13 is a perspective view of the connector 200 from which the internal insulation unit 231 is further removed. Also, FIG. 14 is a side view of the connector 200, and FIG. 15 is a top view of the connector 200. FIG. 16 is a cross-sectional view for illustrating a 15A-15B cross section, where the dashed line 15A-15B is shown in FIG. 15. FIG. 17 is a side view for illustrating the connector 200 from which the internal insulation unit 231 is removed.

In the connector of the present embodiment, in a case where the positive jack terminal 223 corresponds to the first positive jack terminal, the second positive jack terminal (not shown) is disposed closer to the printed substrate 230 in comparison to the positive jack terminal 223. Moreover, the resistor and the capacitor (not shown) coupled to the first positive jack terminal are disposed on the printed substrate 230.

Herein above, although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electrical connector connectable to a mating electrical connector for supplying electric power from a power supply, the electrical connector comprising:

a first jack terminal connected to a first pole of the power supply and configured to be coupled to a first plug terminal of the mating connector;

a second jack terminal connected to a second pole of the power supply and configured to be coupled to a second plug terminal of the mating connector; and a third jack terminal connected to the second pole of the power supply and configured to be coupled to the second plug terminal of the mating connector, a resistor and a capacitor being connected between the third jack terminal and the second pole of the power supply in series;

wherein upon the electrical connector being separated from the mating electrical connector, the second jack terminal is separated from the second plug terminal after the third jack terminal is separated from the second plug terminal, and the first jack terminal is separated from the first plug terminal after the second jack terminal is separated from the second plug terminal.

2. The electrical connector as claimed in claim 1, wherein the first plug terminal is a negative plug terminal; and the second plug terminal is a positive plug terminal.

3. A electrical connector comprising:

a female electrical connector; and a male electrical connector;

wherein the female electrical connector is the electrical connector of claim 1;

wherein the male electrical connector is the mating electrical connector; and the mating electrical connector includes the first plug terminal and the second plug terminal.

* * * * *